US006570505B1

(12) United States Patent
Malenfant

(10) Patent No.: US 6,570,505 B1
(45) **Date of Patent: *May 27, 2003**

(54) LED LAMP WITH A FAULT-INDICATING IMPEDANCE-CHANGING CIRCUIT

(75) Inventor: Martin Malenfant, Chambly (CA)

(73) Assignee: Gelcore LLC, Valley View, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,879

(22) Filed: Dec. 30, 1997

(51) Int. Cl.[7] ..... G08B 21/00

(52) U.S. Cl. ..... 340/641; 340/635; 340/931; 73/866.4; 73/865.9; 315/136; 307/108; 361/58; 361/92; 361/115

(58) Field of Search ..... 340/641, 642, 340/635, 912, 931, 907, 458; 73/865.6, 865.9, 866.4; 315/135, 136; 307/37, 10.8; 324/133; 361/58, 18, 92, 115

(56) References Cited

U.S. PATENT DOCUMENTS

| | | | | |
|---|---|---|---|---|
| 1,348,618 A | | 3/1920 | Zorger | |
| 1,977,689 A | | 10/1934 | Müller | 179/329 |
| 2,254,961 A | | 2/1941 | Harris | 240/106.1 |
| 2,254,962 A | | 2/1941 | Harris et al. | 240/106.1 |
| 2,441,893 A | | 5/1948 | McKee | 274/1 |
| 2,469,080 A | | 3/1949 | Rosin et al. | 240/106.1 |
| 2,547,088 A | | 3/1951 | Norton | 197/188 |
| 2,631,726 A | | 5/1953 | Auer | 209/157 |
| 2,908,197 A | | 10/1959 | Wells et al. | 88/1 |
| 3,307,175 A | | 2/1967 | Shill | 340/380 |
| 3,529,230 A | * | 9/1970 | Tedd | 340/514 |
| 3,553,428 A | | 1/1971 | McGhee | 219/494 |
| 3,710,231 A | | 1/1973 | Baker | 323/9 |
| 3,845,404 A | | 10/1974 | Trilling | 330/69 |
| 3,923,381 A | | 12/1975 | Winston | 350/293 |
| 3,957,031 A | | 5/1976 | Winston | 126/270 |

(List continued on next page.)

FOREIGN PATENT DOCUMENTS

| | | | |
|---|---|---|---|
| CA | 1238941 | 5/1988 | H04N/1/036 |
| CA | 1250972 | 3/1989 | G09G/3/00 |
| CA | 1269834 | 5/1990 | H01L/23/00 |
| DE | 3535204 | 4/1986 | G08B/5/00 |

(List continued on next page.)

OTHER PUBLICATIONS

Wilford, W. T. and Winston, R., The Optics of Non–Imaging Concentrators, Light and Solar Energy: Academic Press, pp. 47–69 (1978).

Ning, X., Winston, R., and O'Gallagher J., Dielectric Totally Internally Reflecting Concentrators: *Applied Optics*, vol. 26, No. 2, pp. 300–305 (Jan. 1987).

(List continued on next page.)

*Primary Examiner*—Julie Lieu
(74) *Attorney, Agent, or Firm*—Orum & Roth

(57) ABSTRACT

In a light-emitting-diode lamp, there is provided an input impedance-changing circuit for establishing a low input impedance circuit when the light-emitting-diode lamp is missingline turned off. This input impedance-changing circuiting comprises Shunt circuit section, and a detector circuit section. The shunt circuit section includes a low impedance element and a controllable switching device connected in series. The detector circuit section detects turning off of the light-emitting-diode lamp and, in response to such detection, close the switching device to thereby cause electric current to flow through the shunt circuit section in order to simulate lower input impedance of the light-emitting-diode lamp. When the light-emitting-diode lamp replaces a conventional traffic signal incandescent lamp, the input impedance-changing circuitry prevents the conflict monitor of the already installed traffic-light lamp system to detect a high lamp impedance and accordingly a faulty lamp.

15 Claims, 1 Drawing Sheet

U.S. PATENT DOCUMENTS

| | | | | |
|---|---|---|---|---|
| 4,002,499 | A | 1/1977 | Winston | 136/206 |
| 4,003,638 | A | 1/1977 | Winston | 350/293 |
| 4,013,915 | A | 3/1977 | Dufft | 313/499 |
| 4,066,945 | A | 1/1978 | Korte, Jr. | 318/681 |
| 4,109,304 | A | 8/1978 | Khvalovsky et al. | 362/259 |
| 4,140,959 | A | 2/1979 | Powell | 322/100 |
| 4,140,960 | A | 2/1979 | Ohsawa | 323/4 |
| 4,211,955 | A | 7/1980 | Ray | 315/53 |
| 4,271,408 | A | 6/1981 | Teshima et al. | 340/702 |
| 4,277,728 | A | 7/1981 | Stevens | 315/307 |
| 4,298,869 | A | 11/1981 | Okuno | 340/782 |
| 4,315,207 | A | 2/1982 | Apfel | 323/284 |
| 4,330,813 | A | 5/1982 | Deutsch | 362/244 |
| 4,339,677 | A | 7/1982 | Hoeft | 307/564 |
| 4,521,835 | A | 6/1985 | Meggs et al. | 362/183 |
| 4,523,265 | A | 6/1985 | Deprez | 363/21 |
| 4,560,959 | A | 12/1985 | Rokos et al. | 331/176 |
| 4,630,183 | A | 12/1986 | Fujita | 362/311 |
| 4,630,220 | A | 12/1986 | Peckinpaugh | 364/492 |
| 4,642,745 | A | 2/1987 | Steigerwald et al. | 363/37 |
| 4,654,629 | A | 3/1987 | Bezos et al. | 340/87 |
| 4,657,353 | A | 4/1987 | Clegg | 350/432 |
| 4,669,031 | A | 5/1987 | Regester | 362/16 |
| 4,669,034 | A | 5/1987 | Bansbach et al. | 362/309 |
| 4,684,919 | A | 8/1987 | Hihi | 340/84 |
| 4,698,730 | A | 10/1987 | Sakai et al. | 362/311 |
| 4,727,289 | A | 2/1988 | Uchida | 315/71 |
| 4,729,076 | A | 3/1988 | Masami et al. | 362/235 |
| 4,733,335 | A | 3/1988 | Serizawa et al. | 362/80 |
| 4,851,824 | A | 7/1989 | Murata | 340/701 |
| 4,851,932 | A | 7/1989 | Scheer et al. | 340/907 |
| 4,862,330 | A | 8/1989 | Machida et al. | 362/61 |
| 4,864,216 | A | 9/1989 | Kalata et al. | 323/315 |
| 4,896,092 | A | 1/1990 | Flynn | 323/258 |
| 4,935,665 | A | 6/1990 | Murata | 313/500 |
| 4,939,426 | A | 7/1990 | Menard et al. | 315/192 |
| 4,954,822 | A | 9/1990 | Borenstein | 340/925 |
| 4,962,375 | A | 10/1990 | Hirane et al. | 340/782 |
| 4,965,488 | A | 10/1990 | Hihi | 313/499 |
| 4,998,806 | A | 3/1991 | Tsuji et al. | 350/413 |
| 5,001,609 | A | 3/1991 | Gardner et al. | 362/32 |
| 5,034,600 | A | 7/1991 | Fukuyama | 250/214 |
| 5,043,716 | A | 8/1991 | Latz et al. | 340/782 |
| 5,081,545 | A | 1/1992 | Sugawara et al. | 359/625 |
| 5,084,698 | A | 1/1992 | Sell | 340/701 |
| 5,087,870 | A | 2/1992 | Salesky et al. | 323/276 |
| 5,118,998 | A | 6/1992 | Garbowicz | 315/278 |
| 5,119,235 | A | 6/1992 | Umeda et al. | 359/619 |
| 5,136,287 | A | 8/1992 | Borenstein | 340/925 |
| 5,139,609 | A | 8/1992 | Fields et al. | 156/643 |
| 5,174,649 | A | 12/1992 | Alston | 362/244 |
| 5,177,431 | A | 1/1993 | Smith et al. | 323/349 |
| 5,198,803 | A | 3/1993 | Shie et al. | 340/782 |
| 5,289,112 | A | 2/1994 | Brown et al. | 323/315 |
| 5,301,095 | A | 4/1994 | Teramoto et al. | 363/81 |
| 5,323,305 | A | 6/1994 | Ikeda et al. | 363/98 |
| 5,343,330 | A | 8/1994 | Hoffman et al. | 359/708 |
| 5,345,335 | A | 9/1994 | Costrop et al. | 359/628 |
| 5,352,931 | A | 10/1994 | Yang | 307/81 |
| 5,373,384 | A | 12/1994 | Hebert | 359/161 |
| 5,414,340 | A | 5/1995 | Gannon | 323/266 |
| 5,436,764 | A | 7/1995 | Umetani et al. | 359/566 |
| 5,489,771 | A | 2/1996 | Beach et al. | 250/205 |
| 5,521,471 | A | 5/1996 | Yang | 318/251 |
| 5,532,918 | A | 7/1996 | Mayrand et al. | 363/89 |
| 5,543,771 | A | 8/1996 | Levin | 336/10 |
| 5,548,205 | A | 8/1996 | Monticelli | 323/274 |
| 5,550,459 | A | 8/1996 | Laplace | 323/255 |
| 5,568,136 | A | 10/1996 | Hochstein et al. | 340/903 |
| 5,576,941 | A | 11/1996 | Nguyen et al. | 363/21 |
| 5,600,546 | A | 2/1997 | Ho et al. | 363/21 |
| 5,619,404 | A | 4/1997 | Zak | 363/21 |
| 5,633,629 | A | 5/1997 | Hochstein | 340/907 |
| 5,636,057 | A | 6/1997 | Dick et al. | 359/625 |
| 5,654,705 | A | 8/1997 | Houten et al. | 340/944 |
| 5,661,645 | A | 8/1997 | Hochstein | 363/89 |
| 5,673,184 | A | 9/1997 | Rilly et al. | 363/21 |
| 5,675,483 | A | 10/1997 | Rademaker et al. | 363/70 |
| 5,712,780 | A | 1/1998 | Youn et al. | 363/131 |
| 5,771,160 | A | 6/1998 | Seong | 363/20 |
| 5,783,909 | A | 7/1998 | Hochstein | 315/159 |

FOREIGN PATENT DOCUMENTS

| | | | | |
|---|---|---|---|---|
| DE | 3722578 | | 1/1988 | G08G/1/09 |
| EP | 0449219 | | 3/1991 | F21Q/3/00 |
| EP | 0633163 | | 6/1994 | F21Q/1/00 |
| FR | 2441893 | | 11/1978 | G09C/3/32 |
| FR | 2547088 | | 5/1983 | G09F/9/33 |
| FR | 2631726 | | 5/1988 | G08G/1/095 |
| GB | 2216277 | | 2/1989 | G01R/31/36 |
| GB | 2216277 | A * | 4/1989 | |
| JP | 61185980 | | 8/1986 | H01L/33/00 |
| WO | 8905463 | | 6/1989 | G02B/5/10 |

OTHER PUBLICATIONS

Winston, R.., Principles of Solar Concentrators of a Novel Design: *Solar Energy*, vol. 16, pp. 89–95, Pergamon Press (1974).

Rabl, A., Comparison of Solar Concentrators: *Solar Energy*, vol. 18, pp. 92–111, Pergamon Press (1976).

Winston, R., Ideal Flux Concentrators with Reflector Gap: *Applied Science*, vol. 17, No. 11, pp. 1668–1669 (Jun. 1, 1978).

Hinterberger, H. and Winston, R., Efficient Light Coupler for Threshold Cerenkov Counters, pp. 1094–1095 (Mar. 1996).

Mannan, K. D. and Cheema, L. S., Technical Note: *Solar Energy*, vol. 19, pp. 751–754, Pergamon Press (1977).

Mills, D. R. and Guitronich, J. E., Assymetrical Non–Imaging Cylindrical Solar Concentrators: *Solar Energy*, vol. 20, pp. 45–55, Pergamon Press (1978).

Collares–Peireira, M., Rabl, A., and Winston, R., Lens–Mirror Combinations with Maximal Concentration: *Applied Optics*, vol. 16, No. 10, pp. 2677–2683 (Oct. 1977).

Harper, D. A., Hildebrand, R. H., Steining, R., and Winston, R., Heat Trap: An Optimized Far Infrared Field Optics System: *Applied Optics*, vol. 15, No. 1, pp. 53–60 (Jan. 1976).

Rabl, A. and Winston, R., Ideal Concentrators for Finite Sources and Restricted Exit Angles: *Applied Optics*, vol. 15, No. 11, pp. 2880–2883 (Nov. 1976).

Williamson, D. E., Cone Channel Condenser Optics: *Journal of the Optical Society of America*, vol. 42, No. 10, pp. 712–715 (Oct. 1952).

Winston, R., Cone Collectors for Finite Sources: *Applied Optics*, vol. 17, No. 5, pp. 688–689 (Mar. 1978).

Schuster, B. G. and Watson, R. D., Passive Optical Shutter for Reducing the Fluorescent Output of a Pulsed Ruby Laser: p 419 (Nov. 1967).

Russell, J. R., Butler, C. T. and Cantrell, E. S., Improved Seed Holder for Kyropoulos Apparatus: p. 1094 (Mar. 1966).

Levi–Setti, R., Park, D. A. and Winston, R., The Corneal Cones of Limulus as Optimized Light Concentrators: *Nature*, vol. 253, pp. 115–116 (Jan. 1975).

Hinterberger, H. and Winston, R. Use of a Solid Light Funnel to Increase Phototube Aperture Without Restricting Angular Acceptance: pp. 1217–1218 (Apr. 1968.).
Winston, R., Dielectric Compound Parabolic Concentrators: *Applied Optics*, vol. 15, No. 2, pp. 291–292 (Feb. 1976).
Large Information Display LED Lamp, "Honeycomb Wide" (date unknown).
Motorola Semiconductor Technical Data, Advance Information, Power Factor Controllers, MC34262, MC33262, 1993.
The Photonics Dictionary, The Optical Industry & Systems Purchasing Directory, 1981.

* cited by examiner

LED LAMP WITH A FAULT-INDICATING IMPEDANCE-CHANGING CIRCUIT

BACKGROUND OF THE INVENTION

1. Field of the Invention

The present invention is concerned with a fault-indicating impedance-changing circuit installed into a load, in particular but not exclusively a light-emitting-diode (LED) lamp.

2. Brief Description of the Prior Art

Incandescent lamps are conventionally used in traffic lights. As well known to those of ordinary skill in the art, a traffic light also includes a conflict monitor (a) to detect turning on of the lamp when it should be turned off and (b) to sense the impedance of the filament of the incandescent lamp to detect failure of the lamp. This conflict monitor is usually designed to operate with incandescent lamps having a rated nominal power of the order of 150 watts and an impedance lower than 1500 Ω.

When the power switch through which the incandescent lamp is turned on and turned off is open, a small current is supplied to the filament of the incandescent lamp through a shunt impedance element connected in parallel to the power switch. Upon selecting the impedance of the shunt impedance element, the two following factors are taken into consideration:

- the impedance of the incandescent lamp is lower than 1500 Ω; and
- the voltage measured across the incandescent lamp must not exceed a given voltage threshold when the lamp is in good condition, since detection of a voltage amplitude across the lamp higher than this given voltage threshold indicates a failure of the lamp.

A newly developed technology enables production of LED lamps that meet with the traffic signalling standards regarding light intensity. These LED lamps consume an electric power as low as 20 watts.

However, replacement of an incandescent lamp by a LED lamp raises the problem that light emitting diodes must be supplied with direct current and the input impedance of the required ac-to-dc power supply, included in the LED lamp, is high (when the LED lamp is turned off) if compared to the impedance of the filament of an incandescent lamp.

The easiest solution to the above discussed problem is to permanently connect an impedance element lower than 1500 Ω in parallel to the LED lamp. However, this solution is itself the source of the following problems:

- a resistive impedance (resistor) will increase the level of electric power consumed by the LED lamp;
- a reactive impedance (capacitor and/or inductor) will reduce the power factor of the lamp; and
- in case of a failure of the light emitting diodes and/or the ac-to-dc power supply, the impedance of the LED lamp does not change sufficiently to allow the conflict monitor to detect a fault.

Upon detection of a fault, namely turning on of a lamp when it should be turned off or failure of a lamp, the conflict monitor activates a safety system to cause all the red and yellow lamps of the traffic light to flash for thereby warning the automobilists crossing the corresponding junction.

As road safety must not be neglected, LED lamps must be designed to enable the conflict monitor to detect a fault and activate the safety system in view of warning the automobilists.

OBJECTS OF THE INVENTION

An object of the present invention is therefore to overcome the above discussed problems by providing a fault-indicating impedance-changing circuit usable in a LED lamp.

SUMMARY OF THE INVENTION

More specifically, in accordance with the present invention, in an electric load, there is provided an input impedance-changing circuitry for establishing a low input impedance circuit of the electric load when this electric load is turned off. The input impedance-changing circuitry comprises (a) a shunt circuit section including a low impedance element and a controllable switching device connected in series, and (b) a detector circuit section for detecting turning off of the electric load and for closing, in response to detection of turning off of the electrical load, the controllable switching device. Closure of the switching device establishes a shunt circuit including the low impedance element and thereby establishes the low input impedance circuit of the electric load.

Also according to the present invention, in a light-emitting-diode lamp, there is provided an input impedance-changing circuitry for establishing of low input impedance circuit. the light-emitting-diode lamp when this light-emitting-diode lamp is turned off, comprising a shunt circuit section including a low impedance element and a controllable switching device connected in series, and a detector circuit section for detecting turning off of the light-emitting-diode lamp and for closing, in response to detection of turning off of the light-emitting diode lamp, the controllable switching device. This establishes a shunt circuit including the low impedance circuit element and thereby establishes the low input impedance circuit of the light-emitting-diode lamp.

Further in accordance with the present invention, there is provided a traffic-light lamp system comprising:

- a light-emitting-diode lamp comprising an input impedance-changing circuitry for establishing a low input impedance circuit of the light-emitting-diode lamp when that light-emitting-diode lamp is turned off, this input impedance-changing circuitry comprising:
  - a shunt circuit section including a first low impedance element and a first controllable switching device connected in series; and
  - a detector circuit section for detecting turning off of the light-emitting-diode lamp and for closing, in response to detection of turning off of the light-emitting-diode lamp, the first controllable switching device in order to establish a shunt circuit including the first low impedance element and thereby establish the low input impedance circuit of the light-emitting-diode lamp; and
  - a second controllable switching device interposed between a source of electric power and the light-emitting-diode lamp for selectively turning on and turning off the light-emitting-diode lamp.

Establishing a low input impedance circuit in a light-emitting-diode lamp when turned off prevents a conventional conflict monitor of a traffic-light lamp system to detect failure of the light-emitting-diode lamp through detection of a high impedance of that lamp.

According to a first preferred embodiment:

- the second controllable switching device comprises a power switch for supplying, when this power switch is closed, the light-emitting-diode lamp with electric power from the above mentioned source and thereby turning on the light-emitting-diode lamp, and a second impedance element connected in parallel with the power switch;
- the source of electric power is an ac source, the light-emitting-diode lamp further comprises (a) a set of light emitting diodes, (b) a rectifier circuit section supplied with ac voltage and current from the ac source through the first controllable switching device and having an output for delivering rectified voltage and current, and (c) a power converter supplied with rectified voltage and current from the rectifier circuit section for producing dc voltage and current supplied to the set of light emitting diodes, and the shunt circuit section is connected between the output of the rectifier circuit section and the ground and is therefore supplied with rectified voltage and current from the rectifier circuit section; and the shunt circuit section comprises a resistor forming the first low impedance element, a capacitor and the first controllable switching device connected in series.

In accordance with a second preferred embodiment of the present invention:

the detector circuit section comprises a comparator having a first input supplied with a predetermined voltage threshold, a second input supplied with a voltage across the capacitor, and an output for delivering a first signal when the amplitude of the voltage across the capacitor is lower than the predetermined voltage threshold, this first signal being indicative of turning off of the light-emitting-diode lamp and being supplied to the first controllable switching device to close that first switching device;

the set of light emitting diodes comprises a plurality of subsets of serially interconnected light emitting diodes, these subsets of serially interconnected light emitting diodes being connected in parallel;

the detector circuit section detects a dc current flowing through each subset of serially interconnected light emitting diodes and produces a second signal when no dc current is flowing through a predetermined number of subsets; and the detector circuit section detects the amplitude of the dc current supplied to the set of light emitting diodes when the power switch is closed, produces a third signal when the amplitude of the dc current supplied to the set of light emitting diodes, when the power switch is closed, is higher than a predetermined current threshold and, in response to the second and third signals, prevents the first signal to reach the first controllable switching device to close that first switching device.

In accordance with a third preferred embodiment of the subject invention:

the detector circuit section comprises a comparator having a first input supplied with a predetermined voltage threshold, a second input supplied with a voltage across the capacitor, and an output for delivering a first signal when the amplitude of the voltage across the capacitor is lower than the predetermined voltage threshold, this first signal being indicative of turning off of the light-emitting-diode lamp and being supplied to the first controllable switching device to close that first switching device;

the detector circuit section (a) detects the amplitude of the ac voltage supplied to the rectifier circuit section when the power switch is closed, and produces a second signal when the amplitude of the ac voltage supplied to the rectifier circuit, when the power switch is closed, is higher than a predetermined voltage threshold, (b) detects the amplitude of the dc current supplied to the set of light emitting diodes when the power switch is closed, and produces a third signal when the amplitude of the dc current supplied to the set of light emitting diodes, when the power switch is closed, is higher than a predetermined current threshold; and in response to the second and third signals, prevents the first signal to reach the controllable switching member to close that switching member.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
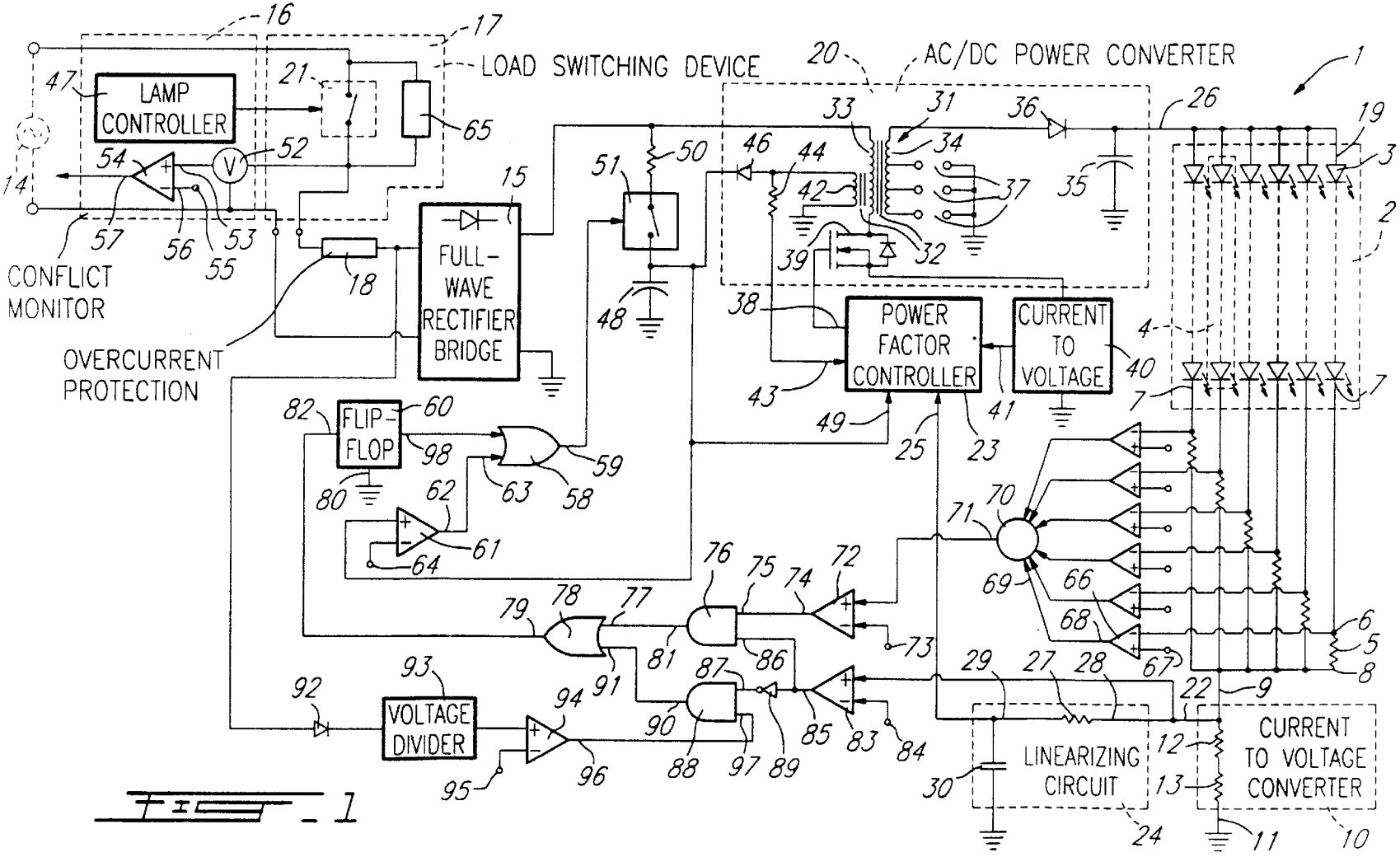
FIG. 1 is a schematic diagram of the electronic circuit of a LED (light-emitting-diode) lamp incorporating a fault-indicating impedance-changing circuit embodying the present invention.

Although the preferred embodiment of the present invention will be described hereinafter with reference to an application of a fault-indicating impedance-changing circuit according to the invention to a LED lamp, it should be kept in mind that this example is not intended to limit the range of applications of the present invention.

Referring to FIG. 1 of the appended drawings, the LED lamp is generally identified by the reference 1. Lamp 1 comprises a set 2 of light emitting diodes such as 3. The set 2 is formed of a plurality of subsets such as 4 of serially interconnected light emitting diodes 3. The subsets 4 of serially interconnected light emitting diodes 3 are connected in parallel to each other to form the set 2.

A current-to-voltage converter, namely a resistor 5 has a first terminal 6 connected to the cathode 7 of the last light emitting diode 3 of each subset 4, and a second terminal 8 connected to a first terminal 9 of a current-to-voltage converter 10. The current-to-voltage converter 10 has a second terminal 11 connected to the ground. As illustrated in FIG. 1, the current-to-voltage converter 10 is formed of two serially interconnected resistors 12 and 13.

Those of ordinary skill in the art will appreciate that a voltage signal having an amplitude representative of the magnitude of the dc current flowing through each subset 4 of light emitting diodes 3 is produced across the corresponding resistor 5 and the serially interconnected resistors 12 and 13, and is available on the terminal 6 of resistor 5. In the same manner, those of ordinary skill in the art will appreciate that the two serially interconnected resistors 12 and 13 produce a voltage signal having an amplitude proportional to the magnitude of the current flowing through all the subsets 4 of light emitting diodes 3. Of course, the serial resistors 12 and 13 can be replaced by a single resistor having a corresponding resistance value.

The set 2 of light emitting diodes 3 is supplied by an ac (alternating current) source 14. Alternating voltage and current from the ac source 14 is supplied to a full-wave rectifier bridge 15 through a conflict monitor 16, a load switching device 17, and an overcurrent protection 18. The alternating voltage and current from the ac source 14 is rectified by the full-wave rectifier bridge 15 and supplied to the anode 19 of the first diode 3 of each subset 4 through an ac-to-dc power converter 20. As explained in the following description, the load switching device 17 comprises a controllable power switch 21 to selectively connect the ac source 14 to the lamp 1 in order to selectively switch the lamp 1 on and off.

As indicated in the foregoing description, the current flowing in all the subsets 4 of light emitting diodes 3 flow through the serial resistors 12 and 13 of the current-to-voltage converter 10. Accordingly, the serial resistors 12 and 13 convert the total current flowing through the set 2 of light emitting diodes 3 into a corresponding current-representative voltage signal delivered on an output 22 of converter 10.

The lamp 1 further comprises a power factor controller 23. In the illustrated example, the controller 23 is the power factor controller manufactured and commercialized by the company Motorola and identified by the reference MC34262. To allow the power factor controller 23 to perform a current feedback control of the supply of the set 2 of light emitting diodes 3, a linearizing circuit 24 is required.

The voltage/current characteristic of a light emitting diode is sensitive to temperature and the current through a light emitting diode changes very rapidly and non linearly with the voltage across this light emitting diode. For example, for a given type of light emitting diode widely used in the fabrication of traffic lights, a constant voltage of 1.8 volt will produce in the light emitting diode a current of about 7.5 mA at a temperature of −25° C., a current of about 20.5 mA at a temperature of +25° C., and a current of about 30 mA at a temperature of +60° C. The amplitude of the current through the light emitting diode at a temperature of +60° C. is therefore, for a constant voltage, about 1.6 time higher than the amplitude of the current at a temperature of +25° C. Voltage feedback control would therefore be very detrimental to the durability of light emitting diodes.

It is obvious from the foregoing description that voltage feedback control of the supply of a light emitting diode is not desirable, and that current feedback control is required to ensure durability of the light emitting diodes.

The controller 23 is not capable of conducting a direct current feedback control of non linear loads such as light emitting diodes. To enable the controller 23 to current feedback control the set 2 of light emitting diodes 3, the linearizing circuit 24 is interposed between the output 22 of the voltage-to-current converter 10 and an input 25 of the power factor controller 23. The function of the linearizing circuit 24 is to transform the non linear relation between the LED supply dc voltage at the output 26 of the power converter 20 and the dc current supplied to the set 2 of light emitting diodes 3 into a linear relation.

The linearizing circuit 24 is, in fact, a filter circuit formed of passive elements. More specifically, the linearizing circuit 24 comprises a resistor 27 having a first terminal 28 connected to the output 22 of the current-to-voltage converter 10, and a second terminal 29 connected to the input 25 of the controller 23. The linearizing circuit 24 also comprises a capacitor 30 connected between terminal 29 of the resistor 27 and the ground. To transform the non linear relation between the LED supply dc voltage at the output 26 of the power converter 20 and the dc current supplied to the set 2 of light emitting diodes 3 into a linear relation, the values of the resistor 27 and capacitor 30 must be precisely and carefully adjusted in relation to the current-to-voltage converting characteristic of the converter 10 and the voltage/current characteristic of the type of diode 3 being used.

By means of a simple filter circuit (linearizing circuit 24) integrated into the current feedback loop, the non linear charge (set 2 of light emitting diodes 3) is sensed by the controller 23 as a linear charge. More specifically, the input voltage feedback signal on the input 25 of the controller 23 varies linearly with the LED supply dc voltage at the output 26 of the power converter 20. To current feedback control the supply of the set 2 of light emitting diodes 3, the controller 23 requires on its input 25 a current-representative voltage feedback signal which varies linearly with the LED supply dc voltage at the output 26 of the power converter 20.

Still referring to FIG. 1, the power converter 20 comprises an inductor device 31 having a core 32, and a coil 33 supplied with full-wave rectified voltage and current from the rectifier bridge 15. A second multi-tap coil 34 is wound onto the core 32 of the inductor device 31. The coils 33 and 34 act as primary and secondary windings, respectively, of a transformer. Rectified voltage and current applied to the coil 33 will induce in the coil 34 rectified voltage and current transmitted to a capacitor 35 through a diode 36. Electrical energy is stored in the capacitor 35 to convert the full-wave rectified voltage and current induced in the coil 34 to dc voltage and current supplied to the output 26 of the power converter 20 and therefore to the set 2 of light emitting diodes 3. Diode 36 prevents return of the electrical energy stored in the capacitor 35 toward the coil 34. The level of the dc voltage across the capacitor 35 and therefore the level of the LED supply dc voltage on the output 26 can be adjusted by selecting the appropriate tap 37 of the coil 34.

Supply of coil 33 of the inductor device 31 is controlled by an output 38 of the controller 20 through a MOSFET power transistor 39. The current supplying the coil 33 is converted to a voltage signal by a current-to-voltage converter 40 connected between transistor 39 and the ground. The current-to-voltage converter 40 comprises an output for supplying the voltage signal to an input 41 of the controller 23.

The current through the coil 33 is also measured through an additional coil 42 also wound on the core 32 of the inductor device 31. The current-representative voltage appearing across the additional coil 42 is supplied to an input 43 of the controller 23 through a resistor 44.

The additional coil 42 is also connected to an accumulator, formed by a capacitor 48, through a diode 46. The function of the accumulator 48 is to supply an input 49 of the controller 23 with a dc voltage amplitude higher than a given minimum voltage reference to enable operation of the controller 23.

The controller 23 is therefore responsive to the current-representative voltage feedback signal on its input 25, to the voltage signal on its input 41, to the current-representative voltage on its input 43, and to the voltage across the capacitor 48 (input 49) to regulate the amplitude of the dc current supplied to the set 2 of light emitting diodes 3. Referring to appended FIG. 1, the controller 23 has its output 38 connected to the MOSFET transistor 39 to control, through this MOSFET transistor, the level of the current through the coil 33 and thus the amplitude of the dc voltage on the output 26. In particular, the controller 23 changes the amplitude of the dc voltage on the output 26 of the power converter 20 so as to maintain the dc current through the light emitting diodes 3 below a predetermined threshold. The durability of the light emitting diodes will not be prejudiced as long as the dc current through the light emitting diodes 3 is lower than this predetermined threshold.

The full-wave rectified current drawn through the coil 33 by the MOSFET transistor 39, under the control of the power factor controller 23, is proportional to the full-wave rectified voltage at the output of the full-wave rectifier bridge 15. More specifically, the current waveform is sinusoidal and in phase with the voltage waveform so that the power factor is, if not equal to, close to unity.

Operation of the power factor controller MC34262 is believed to be otherwise well known to those of ordinary skill in the art and, accordingly, will not be further described in the present specification.

The conflict monitor 16 comprises a lamp controller 47 to control opening and closing of the power switch 21 to turn on or turn off the lamp 1.

When the switch 21 passes from an open to a closed position, the lamp 1 is instantaneously supplied with electric power but the set 2 of light emitting diodes is supplied only after a start time. The duration of this start time is determined by the time required to charge the accumulator, more specifically the capacitor 48 to reach a minimum operation voltage of the power factor controller 23. Indeed, as already mentioned in the foregoing description, the voltage across capacitor 48 is supplied to an input 49 of the power factor controller 23 and this power factor controller will not operate as long as the voltage applied to its input 49 has not reached this minimum operation voltage. When the voltage across the capacitor 48 has reached the minimum operation voltage, operation of the power factor controller 23 is authorized and power is transmitted to the set 2 of light emitting diodes 3 through the converter 20.

Fast charging of the capacitor 48 is enabled by a low-impedance shunt element, for example a low-impedance resistor 50. More specifically, capacitor 48 is charged through the low-impedance resistor 50 and a normally closed switching device 51. Of course, the low-impedance resistor 50 accelerates charging of the capacitor 48 to reduce the start time.

As will be seen in more detail in the following description, a second function of the shunt circuit formed by the low-impedance resistor 50, the s witching device 51 and the capacitor 48 is to establishing a low input impedance circuit of the lamp 1 when the power switch 21 of the load switching device 17 is open. The impedance of the amp 1 is sensed, when the power switch 21 is open, by detecting the voltage across the lamp 1 through a volmeter 52 of the conflict monitor 16. The voltage detected by the voltmeter 52 is applied to the non-inverting input 53 of a comparator 54. If the voltage across the lamp 1 exceeds a voltage threshold 55 applied to the inverting input 56 of the comparator 54, a fault-indicating signal is produced on the output 57 of the comparator 54 to indicate to a safety system (not shown) that the lamp 1 has failed. In response to the fault-indicating signal from the output 57 of the comparator 54, the safety system (not shown) causes all the red and yellow lamps of the traffic light to flash for thereby warning the automobilists crossing the corresponding junction.

Closing and opening of the switching device 51 is controlled by the output 59 of an "OR" gate 58. More specifically, a low logic level on the output 59 will close the switching device 51 while a high logic level on the output 59 of the "OR" gate 58 will open the switching device 51. As will be seen in the following description, the outputs of a flip-flop 60 and a comparator 61 are low following turning on of the lamp 1 to produce on the output 59 of the "OR" gate 58 a low logic level which closes the switching device 51.

The voltage across the capacitor 48 is applied to the non-inverting input of the comparator 61. When the amplitude of the voltage across the capacitor 48 exceeds the amplitude of a reference voltage 64 (for example equal to 1.5 time the above mentioned minimum operating voltage of the power factor controller 23) applied to the inverting input of the comparator 61, a high logic level signal is produced on the output 62 of the comparator 61. This high logic level signal is also supplied to a first input 63 of the "OR" gate 58 and transmitted to the switching device 51 to open the latter switching device. When the switching device 51 is open, the coil 42 of the inductor device 31 then forms an auxiliary supply to charge the capacitor 48 through the diode 46. Coil 42 will maintain the charge of the capacitor 48 to a voltage higher than the reference voltage 64. The switching device 51 remains open as long as the lamp 1 is turned on. During this period, the low-impedance resistor 50 is disconnected and supplied with no power to prevent a useless consumption of electric power.

When the lamp controller 47 opens the power switch 21, the lamp 1 is still supplied through a shunt impedance element 65 connected in parallel to the power switch 21. However, because of the voltage drop across the shunt impedance element 65, the auxiliary supply (coil 42) is no longer capable of maintaining across the capacitor 48 a voltage higher than the minimum operating voltage of the power factor controller 23 and the lamp 1 turns off; of course the capacitor 48 discharge in the surrounding circuits. Then, the signal on the non-inverting input of the comparator 61 falls under the reference voltage 64 and the signal on the output 62 passes from a high to a low logic level to close the switching device 51. As the impedance of the resistor 50 is low compared to the impedance of the shunt element 65, the voltage measured by the conflict monitor 16 through the voltmeter 52 is lower than the voltage threshold 55 whereby the conflict monitor 16 detects a good condition of the lamp 1.

Of course, the lamp 1 has been designed to ensure safety of the automobilists. In particular, the lamp 1 has been designed to detect the failure of a given number of light emitting diodes 3 to thereby ensure constant visibility of the lamp 1. Experiments have demonstrated that following failure of more than 20% of the light emitting diodes 3, that is loss of more than 20% of the luminous surface, the lamp 1 is no longer safe. Accordingly, the conflict monitor 16 must detect a failure of the lamp 1 when more than 20% of the light emitting diodes 3 have failed.

To be reliable, the circuit for detecting failure of more than 20% of the light emitting diodes 3 must be capable of operating within a temperature range located between −40° C. and +85° C. As light emitting diodes are very sensitive to variations of temperature and, for that reason, must be current-feedback controlled, a reliable manner to detect failure of the light emitting diodes 3 is to sense the current flowing therethrough. Selection of the number of subsets 4 of series-connected diodes 3 thus becomes an important design parameter. Obviously, those of ordinary skill in the art will appreciate that failure of a single light emitting diode 3 causes complete failure of the corresponding subset.

The maximum current the light emitting diodes 3 can withstand is 1.7 time the nominal current of these light emitting diodes. Since failure of a subset 4 of series-connected light emitting diodes 3 causes the dc current through the remaining subsets 4 to increase, another important design parameter is the maximum current that will be allowed to flow through the diodes 3; this upper limit has been fixed to 1.5 time the nominal current of the light emitting diodes. This design parameter has led to selection of a number of six subsets 4 of series-connected light emitting diodes 3.

With a number of six subsets 4 of light emitting diodes 3, failure of a first subset 4 causes loss of about 16% of the light emitting diodes 3; such a failure is acceptable. Then, the dc current amplitude in the remaining five subsets 4 of light emitting diodes 3 is equal to 1.2 time the nominal current.

Failure of a second subset 4 of light emitting diodes 3 causes loss of more than 20% of the light emitting diodes and the luminous surface; the dc current through the light emitting diodes 3 of the remaining subsets 4 is then 1.5 time the nominal current. Failure of more than 20% of the light emitting diodes 3 must be detected by the conflict monitor 16 since, in such a situation, the LED lamp 1 is no longer safe.

It should be pointed out that the luminous intensity produced by the light emitting diodes 3 is directly proportional to the magnitude of the dc current flowing through these diodes. Upon failure of a subset 4, redistribution of the dc current in the remaining subsets 4 of light emitting diodes 3 prevents reduction of the total luminous intensity produced by the lamp 1. Accordingly, safety of the lamp 1 upon failure of a subset 4 of light emitting diodes 3 is ensured by current-feedback control of the set 2 of light emitting diodes 3.

The circuit for detecting failure of the subsets 4 of light emitting diodes 3 will now be described.

This failure detecting circuit comprises, for each subset 4, a comparator such as 66 having an inverting input connected to the terminal 6 of the resistor 5 associated to the corresponding subset, a non-inverting input connected to a reference voltage 67, and an output 68 connected to an input 69 of an adder 70. The adder 70 has an output 71 connected to the non-inverting input of a comparator 72. The inverting input of the comparator 72 is supplied with a reference voltage 73, and the output 74 of the comparator 72 is connected to an input 75 of an "AND" gate 76. The "AND" gate 76 has an output 81 connected to an input 77 of an "OR" gate 78. The flip-flop 60 has a "Reset" input 80 connected to the ground and a "Set" input 82 connected to an output 79 of the "OR" gate 78.

A comparator 83 has a non-inverting input connected to the output 22 of the current-to-voltage converter 10, an inverting input supplied with a reference voltage 84, and an output 85 connected to both an input 86 of the "AND" gate 76 and an input 87 of an "AND" gate 88 through an inverter 89. The "AND" gate 88 has an output 90 connected to an input 91 of the "OR" gate 78, and an input 97 connected to an output 96 of a comparator 94 having an inverting input supplied with a reference voltage 95. The alternating voltage at the input of the full-wave rectifier bridge 15 is also rectified by a diode 92, and this half-wave rectified voltage is supplied to the non-inverting input of the comparator 94 through a voltage divider 93.

Upon failure of a subset 4 of light emitting diodes 3, no current is flowing through the corresponding resistor 5 and voltage is no longer generated across this resistor 5. Therefore the voltage supplied to the inverting input of the corresponding comparator 66, which is higher than the reference voltage 67 as long as current is flowing through the subset 4, lowers under this reference voltage 67 to produce on the output 68 a high logic level signal supplied to the associated input 69 of the adder 70.

When two subsets 4 of series-connected light emitting diodes 3 fail, the two high logic level signals on the outputs 68 of the two corresponding comparators 66 are summed by the adder 70. Then, the adder 70 delivers on the output 71 a signal having an amplitude higher than the reference voltage 73. The comparator 72 then produces a high logic level signal supplied to the input 75 of the "AND" gate 76. At that time, the current-representative voltage signal on the output 22 has an amplitude higher than the reference voltage 84 since feedback-controlled current is supplied to the set 2 of light emitting diodes 3. A high logic level signal is therefore supplied to the other input 86 of the "AND" gate 76. In response to the high logic level signals on its inputs 75 and 86, the "AND" gate 76 produces on its output 81 a high logic level signal transmitted to the "Set" input 82 of the flip-flop 60 through the "OR" gate 78. Flip-flop 60 then produces a high logic level signal on its output 98, which high logic level signal is stored by the flip-flop 60 and transmitted to the switching device 51 through the "OR" gate 58 to lock this switching device 51 in the open position. When the power switch 21 is subsequently opened by the lamp controller 47, the switching device 51 is locked in the open position whereby the lamp 1 presents a high input impedance. The voltage measured through the voltmeter 52 is then higher than the voltage threshold 55 so that the comparator 54 produces a high logic level signal on its output 57 to signal to the safety system (not shown) failure of the lamp 1. Even if the lamp controller 47 subsequently closes the power switch 21, the switching device 51 remains open to prevent turning on of the lamp 1. As explained in the foregoing description, the switching device 51 must be closed to enable the accumulator (capacitor 48) to charge to the minimum operating voltage of the power factor controller 23.

Accordingly, a failure of more than 20% of the light emitting diodes 3 is detected to lock the switching device 51 in the open position. This allows the conflict monitor 16 to detect failure of the lamp 1 and to signal this failure to the safety system (not shown).

In the same manner, failure of a component of the power supply circuit of the lamp 1 will be detected by the conflict monitor 16.

The amplitude of the alternating voltage at the input of the full-wave rectifier bridge 15 is first detected. For that purpose, this alternating voltage is half-wave rectified by the diode 92 and supplied to the non-inverting input of the comparator 94 through the voltage divider 93. The reference voltage 95 has an amplitude representative of a minimum alternating voltage amplitude required to operate the lamp 1. If the amplitude of the alternating voltage at the input of the full-wave rectifier bridge 15 is higher than this minimum alternating voltage amplitude, the comparator 94 produces on its output 96 a high logic level signal supplied to the input 97 of the "AND" gate 88. On the contrary, if the amplitude of the alternating voltage at the input of the full-wave rectifier bridge 15 is lower than the minimum alternating voltage amplitude required to operate the lamp 1, the comparator 94 produces on its output 96 a low logic level signal supplied to the input 97 of the "AND" gate 88. Normally, the minimum voltage amplitude corresponds to 70% of the nominal alternating voltage of the network.

Supply of the set 2 of light emitting diodes 3 is also detected. As indicated in the foregoing description, the current-representative voltage signal on the output 22 has an amplitude higher than the reference voltage 84 when the set 2 of light emitting diodes 3 is supplied with feedback controlled current. The output 85 of the comparator 83 then delivers a high logic level signal to the inverter 89 to thereby supply the input 87 of the "AND" gate 88 with a low logic level signal. On the contrary, the current-representative voltage signal on the output 22 of the current-to-voltage converter 10 has an amplitude substantially equal to zero when no current is supplied to the set 2 of light emitting diodes 3. The output 85 of the comparator 83 then delivers a low logic level signal supplied to the inverter 89 to thereby supply the input 87 of the "AND" gate 88 with a high logic level signal.

When no current is supplied to the set 2 of light emitting diodes 3 (high logic level signal on the input 87 of the "AND" gate 88) and the amplitude of the alternating voltage at the input of the rectifier bridge 15 is higher than the minimum alternating voltage amplitude required to turn the lamp 1 on (high logic level signal on the input 97 of the "AND" gate 88), failure of the power supply circuit of the lamp 1 should be signalled to the conflict monitor 16. Since a high logic level signal appears on both the inputs 87 and 97, the "AND" gate 88 produces on its output 90 a high logic level signal transmitted to the "Set" input 82 of the flip-flop 60 through the "OR" gate 78. Flip-flop 60 then produces a high logic level signal on its output 98, which high logic level signal is stored by the flip-flop 60 and transmitted to the switching device 51 through the "OR" gate 58 to lock this switching device 51 in the open position. When the switch 21 is subsequently opened by the lamp controller 47, the switching device 51 is locked in the open position whereby the lamp 1 presents a high input impedance. The voltage measured through the voltmeter 52 is then higher than the reference voltage 55 so that the comparator 54 produces a high logic level signal on its output 57 to signal to the safety system (not shown) failure of the lamp 1.

Although the present invention has been described hereinabove by way of a preferred embodiment thereof, this embodiment can be modified at will, within the scope of the appended claims, without departing from the spirit and nature of the subject invention.

What is claimed is:

1. In a light-emitting-diode lamp, the improvement comprising an input impedance-changing circuitry for establishing a low input impedance circuit of the light-emitting-diode lamp when said light-emitting-diode lamp is turned off, said input impedance-changing circuitry comprising:

a shunt circuit section including a low impedance element and a controllable switching device connected in series; and a detector circuit section comprising means for detecting turning off of the light-emitting-diode lamp and means for closing, in response to detection of turning off of the light-emitting diode lamp, the controllable switching device in order to establish a shunt circuit including the low impedance element and thereby establish said low input impedance circuit of the light-emitting-diode lamp.

2. An input impedance-changing circuitry as recited in claim 1, in which:

the light-emitting-diode lamp is supplied with electric power from an ac source;

the light-emitting-diode lamp further comprises (a) a set of light emitting diodes, (b) a rectifier circuit section supplied with ac voltage and current from the ac source and having an output for delivering rectified voltage and current, and (c) a power converter supplied with rectified voltage and current from the rectifier circuit section for producing dc voltage and current supplied to the set of light emitting diodes; and the shunt circuit section is connected between the output of the rectifier circuit section and the ground and is therefore supplied with rectified voltage and current from the rectifier circuit section.

3. An input impedarce-changing circuit as recited in claim 2, in which the shunt circuit section comprises a resistor forming the low impedance element, a capacitor and the controllable switching device connected in series.

4. An input impedance-changing circuitry as recited in claim 3, in which the detector circuit section comprises means for detecting turning off of the light-emitting-diode lamp when the amplitude of a voltage across the capacitor is lower than a predetermined voltage threshold.

5. A input impedance-changing circuitry as recited in claim 3, in which the detector circuit section comprises a comparator having a first input supplied with a predetermined voltage threshold, a second input supplied with a voltage across the capacitor, and an output for delivering a given signal when the amplitude of the voltage across the capacitor is lower than the predetermined voltage threshold, said given signal being indicative of turning off of the light-emitting-diode lamp and being supplied to the controllable switching device to close said switching device.

6. An input impedance-changing circuitry as recited in claim 1, further comprising a set of light emitting diodes including a plurality of subsets of serially interconnected light emitting diodes, wherein the detector circuit section comprises means for detecting a dc current flowing through each subset of serially interconnected light emitting diodes and means for producing a fault signal when no do current is flowing through a predetermined number of said subsets of light emitting diodes.

7. A traffic-light lamp system comprising:

a light-emitting-diode lamp comprising an input impedance-changing circuitry for establishing a low input impedance circuit of the light-emitting-diode lamp when said light-emitting-diode lamp is turned off, said input impedance-changing circuitry comprising:

a shunt circuit section including a first low impedance element and a first controllable switching device connected in series; and a detector circuit section comprising means for detecting turning off of the light-emitting-diode lamp and means for closing, in response to detection of turning off of the light-emitting-diode lamp, the first controllable switching device in order to establish a shunt circuit including the first low impedance element and thereby establish the low input impedance circuit of the light-emitting-diode lamp; and a second controllable switching device interposed between a source of electric power and the light-emitting-diode lamp for selectively turning on and turning off the light-emitting-diode lamp.

8. A traffic-light lamp system as defined in claim 7, wherein the second controllable switching device comprises:

a power switch for supplying, when said power switch is closed, the light-emitting-diode lamp with electric power from said source and thereby turning on said light-emitting-diode lamp; and a second impedance element connected in parallel with the power switch.

9. A traffic-light lamp system as defined in claim 8, wherein:

the source of electric power is an ac source;

the light-emitting-diode lamp further comprises (a) a set of light emitting diodes, (b) a rectifier circuit section supplied with ac voltage and current from the ac source through the second controllable switching device and having an output for delivering rectified voltage and current, and (c) a power converter supplied with rectified voltage and current from the rectifier circuit section for producing dc voltage and current supplied to the set of light emitting diodes; and the shunt circuit section is connected between the output of the rectifier circuit section and the ground and is therefore supplied with rectified voltage and current from the rectifier circuit section.

10. A traffic-light lamp system as defined in claim 9, wherein the shunt circuit section comprises a resistor forming the first low impedance element, a capacitor and the first controllable switching device connected in series.

11. A traffic-light lamp system as defined in claim 10, wherein the detector circuit section comprises means for detecting turning off of the light-emitting-diode lamp when the amplitude of a voltage across the capacitor is lower than a predetermined voltage threshold.

12. A traffic-light lamp system as defined in claim 10, in which the detector circuit section comprises a comparator having a first input supplied with a predetermined voltage threshold, a second input supplied with a voltage across the capacitor, and an output for delivering a first signal when the amplitude of the voltage across the capacitor is lower than the predetermined voltage threshold, said first signal being indicative of turning off of the light-emitting-diode lamp and being supplied to the first controllable switching device to close said first switching device.

13. A traffic-light lamp system as defined in claim 12, wherein:

the set of light emitting diodes comprises a plurality of subsets of serially interconnected light emitting diodes, said subsets of serially interconnected light emitting diodes being connected in parallel; and the detector circuit section comprises means for detecting a dc current flowing through each subset of serially interconnected light emitting diodes and means for producing a second signal when no dc current is flowing through a predetermined number of said subsets.

14. A traffic-light lamp system as defined in claim 13, wherein the detector circuit section comprises:

means for detecting the amplitude of the dc current supplied to the set of light emitting diodes when the power switch is closed;

means for producing a third signal when the amplitude of the dc current supplied to the set of light emitting diodes when the power switch is closed is higher than a predetermined current threshold; and means responsive to the second and third signal for preventing the first signal to reach the first controllable switching device to close said first switching device.

15. A traffic-light lamp system as defined in claim 12, wherein the detector circuit section comprises:

means for detecting the amplitude of the ac voltage supplied to the rectifier circuit section when the power switch is closed;

means for producing a second signal when the amplitude of the ac voltage supplied to the rectifier circuit when the power switch is closed is higher than a predetermined voltage threshold;

means for detecting the amplitude of the dc current supplied to the set of light emitting diodes when the power switch is closed;

means for producing a third signal when the amplitude of the dc current supplied to the set of light emitting diodes when the power switch is closed is higher than a predetermined current threshold; and means responsive to the second and third signals for preventing the first signal to reach the controllable switching member to close said switching member.

* * * * *